US007644452B2

(12) United States Patent
Colin

(10) Patent No.: US 7,644,452 B2
(45) Date of Patent: Jan. 12, 2010

(54) HYDROTHERAPY JET WITH ADJUSTABLE AIR AND WATER INLETS

(75) Inventor: Raymundo Colin, Simi Valley, CA (US)

(73) Assignee: B & S Plastics, Inc., Oxnard, CA (US)

( * ) Notice: Subject to any disclaimer, the term of this patent is extended or adjusted under 35 U.S.C. 154(b) by 235 days.

(21) Appl. No.: 10/923,070

(22) Filed: Aug. 20, 2004

(65) Prior Publication Data

US 2005/0039251 A1 Feb. 24, 2005

Related U.S. Application Data

(60) Provisional application No. 60/497,075, filed on Aug. 22, 2003.

(51) Int. Cl.
*A61H 33/04* (2006.01)

(52) U.S. Cl. ..... 4/541.6

(58) Field of Classification Search ..... 4/541.1–541.6; 239/428.5, 600

See application file for complete search history.

(56) References Cited

U.S. PATENT DOCUMENTS 5,920,925 A 7/1999 Dongo
6,178,570 B1 1/2001 Denst et al.
6,745,413 B2 * 6/2004 Pinciaro ..... 4/541.6
6,848,637 B2 * 2/2005 Holtsnider ..... 239/587.1
6,973,681 B2 * 12/2005 Ayeni et al. ..... 4/541.6
2004/0025245 A1 * 2/2004 Pinciaro ..... 4/541.6

OTHER PUBLICATIONS

Waterway Plastics 1999 Product Catalog, p. 4, Parts, 210-6120 and 210-6510.

Waterway Plastics 2003 Product Catalog, p. 34, "Power and Poly Gunite SPA Jets".

* cited by examiner

*Primary Examiner*—Huyen Le
(74) *Attorney, Agent, or Firm*—Koppel, Patrick, Heybl & Dawson

(57) ABSTRACT

A hydrotherapy jet comprising a jet body having a water inlet and an air inlet to allow water and air to flow into the jet body from water and air conduits, respectively. A diffuser is housed within that jet body and is rotatable within the jet body to control the amount of water flowing into the jet body. The water and air inlets are rotatable about the longitudinal axis of the jet body to align the water and air inlets with the water and air conduits, respectively.

19 Claims, 8 Drawing Sheets

FIG. 1
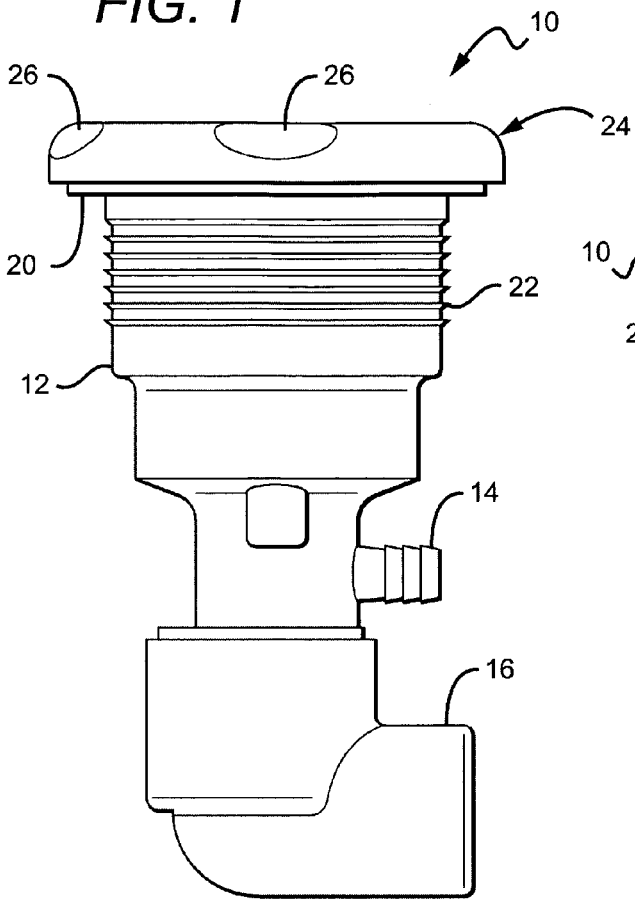
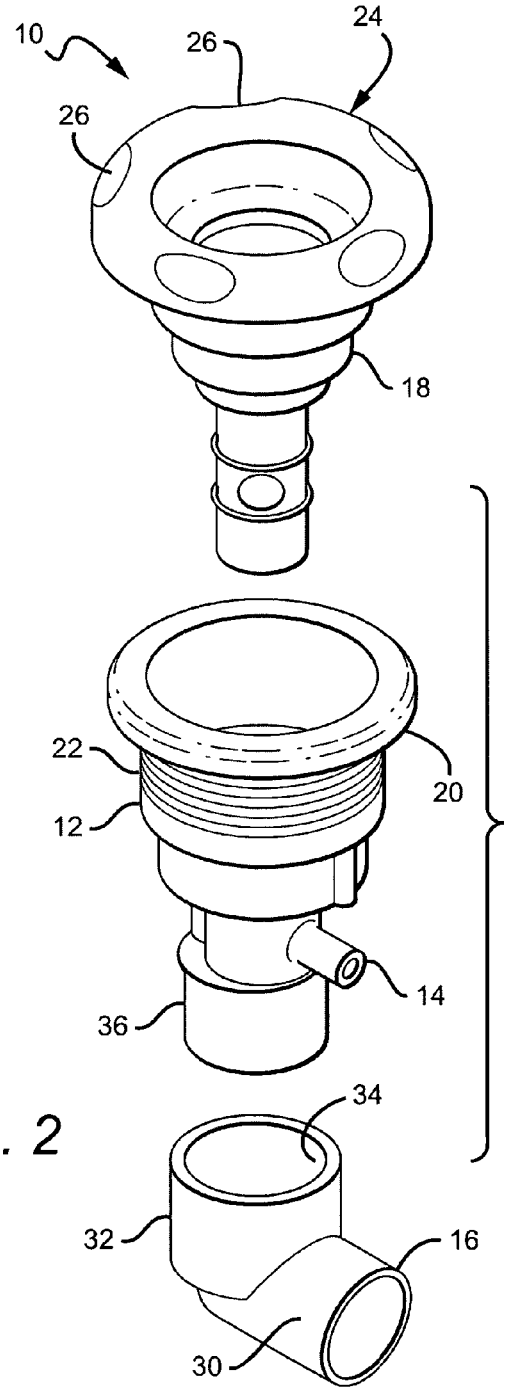
FIG. 2

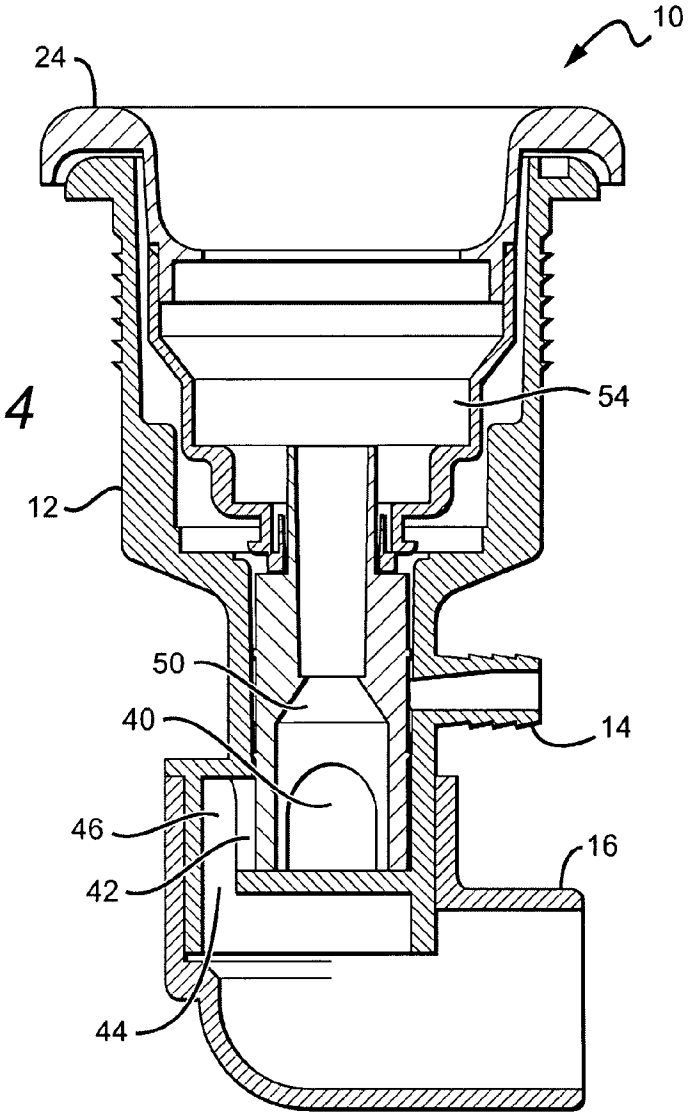
FIG. 4
FIG. 3
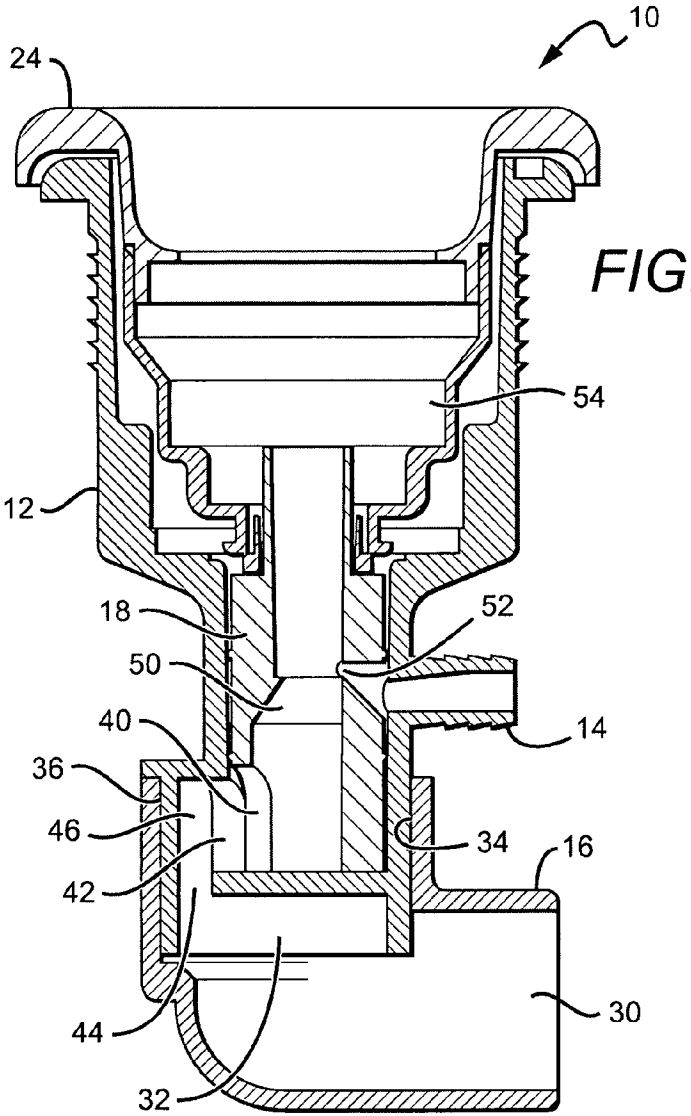

FIG. 5
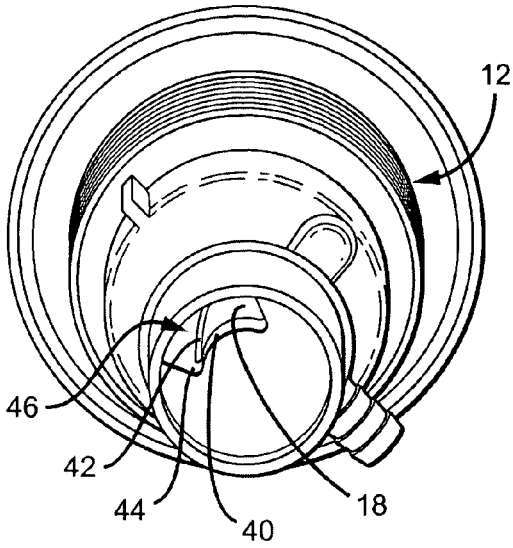
FIG. 6
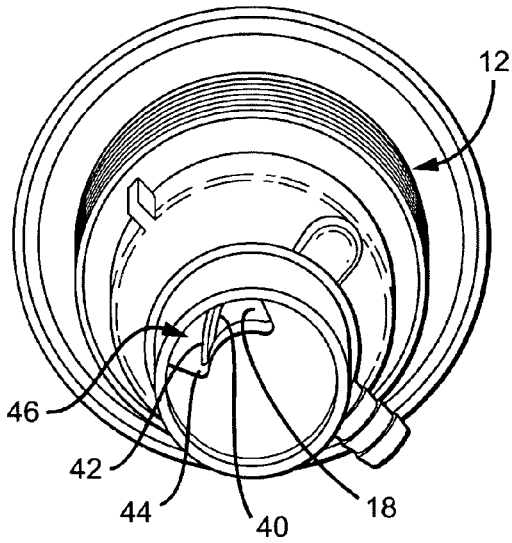
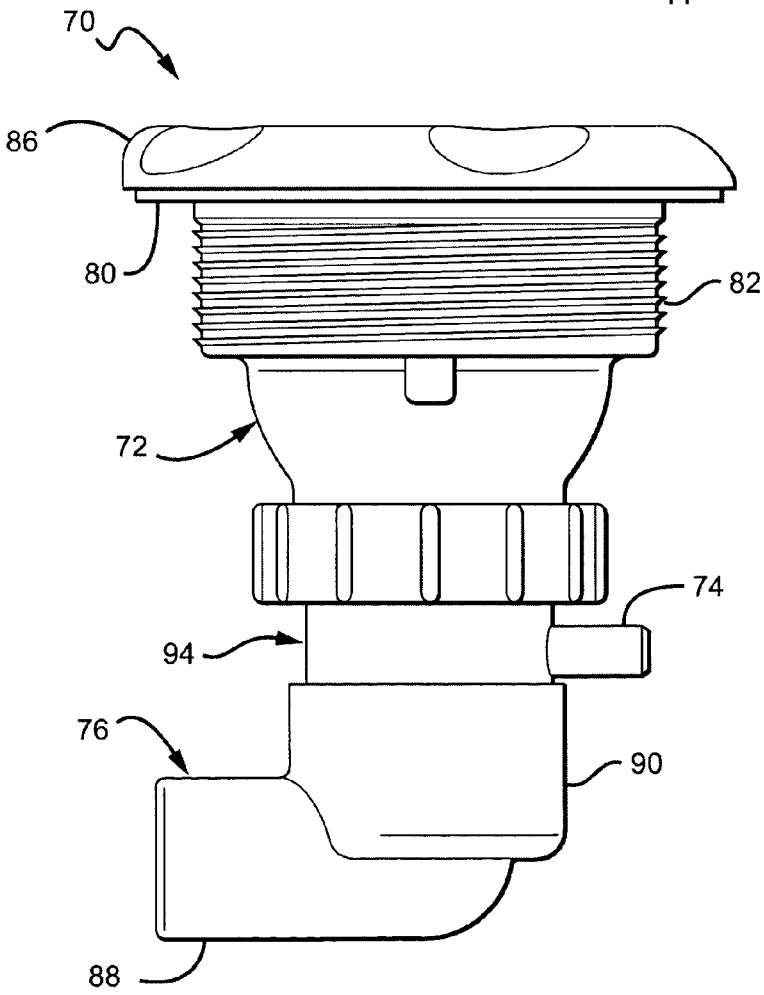
FIG. 7

HYDROTHERAPY JET WITH ADJUSTABLE AIR AND WATER INLETS

This application claims the benefit of provisional application Ser. No. 60/497,075 to Colin, which was filed on Aug. 22, 2003.

BACKGROUND OF THE INVENTION

1. Field of the Invention

This invention relates to hydrotherapy jets.

2. Description of the Related Art

Various hydrotherapy jets have been developed for use in spas, hot tubs, pools and bath tubs that discharge a stream of water, which can be aerated through a variety of discharge nozzles. The designs provide different flow characteristics that result in different massage affects being experienced by the body, and these jets have become quite popular. In the design of single or multi-user spas or tubs, it is common to use a variety of different jet nozzles to provide a variety of different massaging effects.

Early jets simply discharged a stream of warm water along the longitudinal axis of the jet body, with later jets providing aeration of the water stream. Since then, numerous jets have been developed in which the direction of the stream can be adjusted. For example, U.S. Pat. No. 5,269,029 to Spears et al. (assigned to the same assignee as the present invention) discloses a jet that provides an off axis stream of water and has an axial push/pull mechanism used to control the flow of water. The mechanism can also be rotated to rotate the stream of water around the jet axis, providing directional control over the stream.

Jets have also been developed having a rotating outlet or eyeball that automatically rotates in response to the water flowing through the outlet. See Waterway Plastics Inc., "1999 Product Catalog," Page 4, including Part Nos 210-6120 and 210-6510. The jet produces a water jet that passes through the outlet, and the outlet can be adjusted off the jet's longitudinal axis to provide a turning moment in the eyeball in response to the jet flow.

U.S. Pat. No. 6,178,570 to Denst et al. (assigned to the same assignee as the present invention) discloses a jet having a rotating eyeball with one or more discharge outlets that can be adjusted to vary the direction of the outlet flow stream as well as the direction and speed of the eyeball's rotation. A high-pressure water stream flows through the outlets and, depending upon the orientation of the outlets, the eyeball can rotate clockwise or counterclockwise at different speeds.

U.S Pat. No. 5,920,925, to Dongo (assigned to the same assignee as the present invention) discloses a jet having a rotating eyeball and a diverter cap formed with a number of bore holes positioned at a common radius from the center of the cap. The jet produces a high pressure water jet that flows through the eyeball, causing it to rotate at a high speed and discharge the jet in a circular pattern that impinges on the bore holes. Together, the rotational speed and the bore hole design produce the sensation of a number of simultaneously pulsating water jets that are directed into the spa.

Conventional jets can comprise a jet body having a water inlet and an air inlet that are typically perpendicular to the longitudinal axis of the jet body. Water flows into the jet body through the water inlet and a diffuser can be arranged within the body to form the water flow into stream. Air can then flow into the jet body and diffuser through the air inlet to be entrained into the stream of water. The diffuser can also be arranged within the body so that it can be rotated to control the amount of water flowing into the body and through the diffuser. The diffuser can have a hole that is aligned with the water inlet to allow water to flow into the diffuser. When the diffuser is rotated within the body the water inlet and diffuser holes are moved out of alignment, which blocks the water from flowing into the diffuser.

In conventional jets the water and air inlets are molded in a fixed position on the jet body and in most, the water and air inlets are adjacent to one another or on opposite sides of the jet body. Having the inlets in a fixed position can complicate the installation of the jets in the spa because the inlets are often not in a convenient location for aligning and attaching water and air conduits. Additional lengths of conduit can be required and the resulting attached conduits can be overly complex and awkward.

SUMMARY OF THE INVENTION

One embodiment of a hydrotherapy jet according to the present invention comprises a jet body having a water inlet and an air inlet to allow water and air, respectively, to flow into said jet body from water and air conduits. A diffuser is housed within that jet body and is rotatable within the jet body to control the amount of water flowing into the jet body. The water and air inlets are rotatable about the longitudinal axis of the jet body to align the water and air inlets with the water and air conduits, respectively.

Another embodiment of a hydrotherapy jet according to the present invention, comprises a jet body having a water inlet to allow water to flow into the jet body from a water conduit. A diffuser is housed within the jet body and is rotatable within said jet body to control the amount of water flowing into the jet body. The water inlet is rotatable about the longitudinal axis of said jet body to align the water inlet with the water conduit.

One embodiment of a hydrotherapy system comprises a reservoir shell capable of holding water and a plurality of hydrotherapy jets mounted around the reservoir shell. A water pump system circulates water from the reservoir to the jets. A selected one of the hydrotherapy jets comprises a jet body having a water inlet to allow water and to flow into the jet body from a water conduit. The water inlet is rotatable about the jet body to align the water inlet with the water conduit.

One method for installing hydrotherapy jets according to the present invention comprises providing a reservoir shell capable of holding water and forming a hole in the reservoir shell for a hydrotherapy jet. A hydrotherapy jet is provided with an adjustable water inlet and the hydrotherapy jet is mounted in said reservoir shell hole with said water inlet behind the water contacting surface of the shell. A water conduit is provided, the water inlet is adjusted to align it with the water conduit, and the water conduit is mounted to the water inlet.

These and other further features and advantages of the invention will be apparent to those skilled in the art from the following detailed description, taken together with the accompanying drawings, in which:

BRIEF DESCRIPTION OF THE DRAWINGS

FIG. 1 is a side elevation view of one embodiment of a hydrotherapy jet according to the present invention;

FIG. 2 is an exploded view of the jet in FIG. 1;

FIG. 3 is a sectional view of the jet in FIG. 1;

FIG. 4 is another sectional view of the jet in FIG. 1;

FIG. 5 is a bottom perspective view of the jet body of the hydrotherapy jet shown in FIG. 1 without its water inlet;

FIG. 6 is another bottom perspective view of the jet body of the hydrotherapy jet in FIG. 1 without its water inlet; and FIG. 7 is a side elevation view of another embodiment of a hydrotherapy jet according to the present invention;

DETAILED DESCRIPTION OF THE INVENTION

Figure 8:
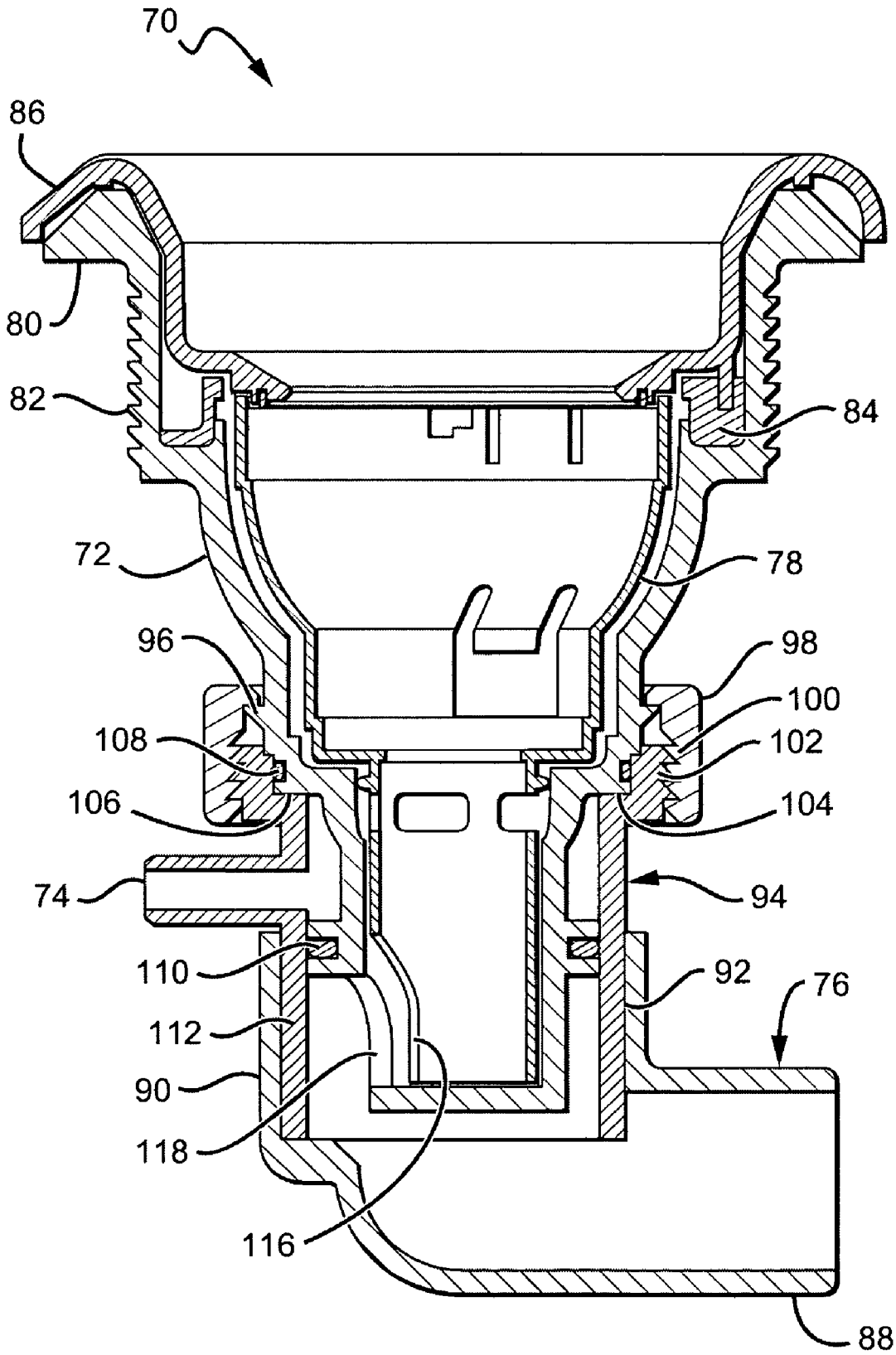
FIG. 8 is a sectional view of the jet in FIG. 7.

FIGS. 1 and 2 show one embodiment of a hydrotherapy jet 10 constructed in accordance with the present invention, having a jet body 12, an air inlet 14, a water inlet 16 and a diffuser 18 (shown in FIG. 2). The jet 10 and its components are preferably formed from a water impervious plastic such as ABS, PVC or CPVC. It is particularly adapted to be positioned below the water level on the spa or tub wall, with the majority of the jet positioned behind the spa's water contacting wall. When installed in a spa or tub, a water conduit is connected to the water inlet 16 to supply water to the jet body 12 and diffuser 18, and an air conduit can be connected to the air inlet to supply air to the body 12 and diffuser 18 where aerated water is desired.

The jet body 12 has an external body flange 20 that is positioned on the spa's water contacting wall. The outside surface of the body 12, adjacent to the flange 20, has a threaded section 22 for mating with the threads of a wall fitting (not shown). A circular gasket or other devices or compounds that provide a watertight seal can be on the wall fitting and/or flange 20 to provide a seal with the wall. The fitting is rotated until the flange 20 tightens against the spa wall and the jet 10 is held securely in place with the spa wall sandwiched between the flange 20 and the fitting.

The diffuser 18 is housed within the jet body 12 by conventional means with the diffuser being rotatable within the body 12 about the jet body's longitudinal axis. The diffuser 18 has a diffuser flange 24 that can include gripping depressions 26. When the jet is installed in a spa, a spa occupant can control the amount of water that passes into the body 12 by grasping the diffuser flange 24 and rotating the diffuser within the body 12 as more fully described below.

Referring now to FIGS. 2 and 3, unlike conventional jets, the water inlet 16 in jet 10 is a separate construction that includes a cylindrical inlet section 30 that is perpendicular to a cylindrical mounting section 32, although other types of inlets can be used such as those wherein the inlet and mounting sections 30, 32 are not perpendicular. The mounting section 32 includes a smooth water inlet mounting surface 34 that is arranged to fit closely over a body mounting surface 36. During installation, the water inlet 16 can be rotated around the jets longitudinal axis, which allows it to be arranged in any orientation about the body mounting surface 36. This allows the inlet to be customized to match the orientation of its water conduit. This feature simplifies the jet and conduit installation process and eliminates the waste associated with modifying the water conduit orientation to match the water inlet 16.

In those installations where an air conduit is used to supply air to the jet 10, the jet 10 can be installed such that its fixed air inlet 14 matches the orientation of the air conduit and the water inlet 16 can then be mounted to match the water conduit. When the water inlet 16 is properly oriented on the body it can be mounted in place with a watertight seal. Convention glues can be used and/or sealants, gaskets, and/or O-rings can be included to provide a watertight seal.

Referring now to FIGS. 3 and 4, the diffuser 18 has a rear opening 40 that allows water to enter the diffuser. In conventional jets, the opening 40 aligns with the fixed side mounted water inlet that allows water to enter the jet body and diffuser through the side opening in the body. In the jet 10, the water enters the jet body 12 from the bottom, through an offset slot opening 42. The bottom of the jet body has a curved longitudinal slot 44 that is offset from the jet body's longitudinal axis. The radius of the slot's inside edge is approximately the same as the radius of the diffuser's bottom section. An axial cavity 46 is included that extends from the slot 44 toward the front of the jet 10 with the cavity 46 also being offset from the jet's longitudinal axis. The slot opening 42 is provided on the inside surface of the cavity 46 and can have different shapes and sizes.

The water inlet 16 fits over the bottom of the jet and water flowing in the inlet flows into the cavity 46. The slot opening 42 is arranged to work with the diffuser opening 40 to control the flow of water into the jet body 12 and diffuser 18 from the cavity 46. As shown in FIG. 3, when the diffuser opening 40 is aligned with the slot opening 42 the maximum amount of water flows into the diffuser 18 through the aligned holes. As the diffuser 18 is rotated within the jet body, the diffuser opening 40 is moved out of alignment with the slot opening 42 to reduce or stop the flow of water. As shown in FIG. 4, when the diffuser opening 40 is out of alignment with the slot opening, water is blocked from entering the diffuser by the wall of the diffuser.

FIGS. 5 and 6 further show the operation of the diffuser opening 40 and the slot opening 42. In FIG. 5 the diffuser opening 40 is aligned with the slot opening 42 such that the maximum amount of water from the water inlet (not shown) flows into the diffuser. In FIG. 6, the diffuser is rotated such that the slot opening 42 and diffuser opening 40 are out of alignment and the water is blocked from entering the diffuser 18 by the diffuser wall. Accordingly, water does not flow into the diffuser.

By having the water enter the jet through the bottom of the body, the orientation of the inlet 16 does not impact the operation of the diffuser 18 in controlling the flow of water through the jet 10. The operation is the same regardless of the inlet's orientation, which provides the flexibility necessary to match the inlet orientation to the orientation of the water conduit.

The remaining operation of the diffuser is known and only briefly described herein. The interior surface of the diffuser 18 has a venturi section 50 (shown in FIGS. 3 and 4) that tapers slightly to accelerate the water flowing through the diffuser, creating a venturi jet. Forward of the venturi section 50 is an axial air passageway 52. Air enters the jet body 12 through the air inlet 14 and the air can then flow to the forward end of the venturi section 50 through the passageway 52. At that location, air is entrained into the water jet due to the venturi action, producing a jet with a desirable water/air mixture that exits through the jet outlet 54. Different components can be included within the jet to provide different features such as a rotating or pulsating jet.

In one embodiment of a installation method for installing the jet 10 in a hydrotherapy spa system, a hole is provided in the spa that is sized for the jet 10 such that the majority of the jet 10 is behind the spa's water contacting wall and the flange 20 is seated against the water contacting wall. The wall fitting is turned onto the jet body 12 to sandwich the spa wall between the wall fitting and jet body to hold the jet in place. The water inlet 16 can then be adjusted (rotated) to align it with the water conduit and then be mounted in place with a watertight seal with the, body 12 such as by gluing. The water conduit can then be mounted to the water inlet 16, also by gluing.

Figure 9:
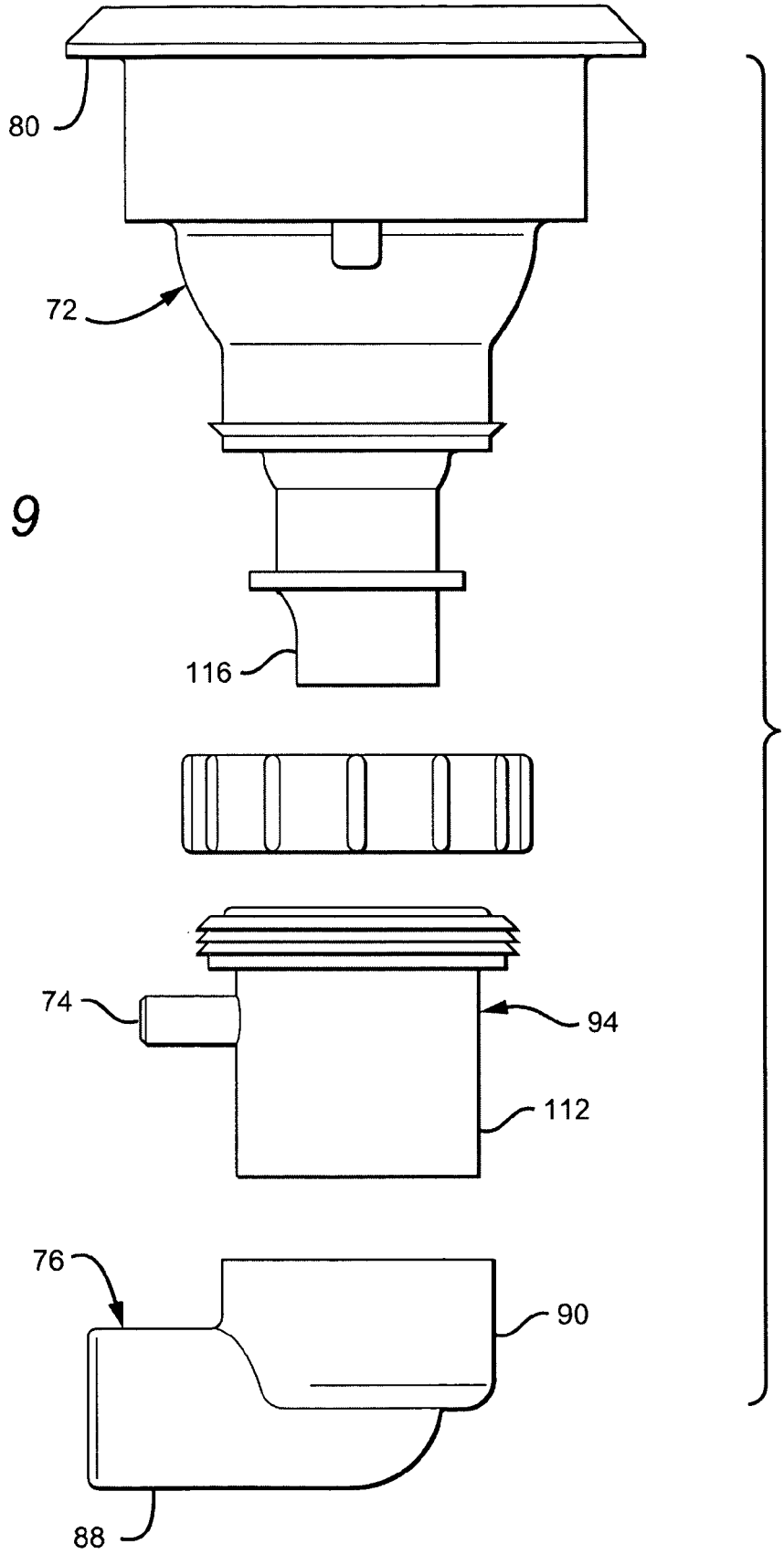
FIG. 9 is an exploded view of the jet in FIG. 7.

FIGS. 7-9 show another embodiment of a hydrotherapy jet 70 constructed in accordance with the present invention, having a jet body 72, an air inlet 74, a water inlet 76 and a diffuser 78 (FIG. 8) similar to those in the jet shown in FIGS. 1-6. The components of jet 70 are also preferably formed from a water impervious plastic such as ABS, PVC or CPVC and the jet 70 is particularly adapted to be positioned below the water level on the spa or tub wall, with the majority of the jet positioned behind the spa's water contacting wall. A water conduit is connected to the water inlet 76 and an air conduit can be connected to the air inlet 74 to supply air to the body 72.

The jet body 72 also has an external body flange 80 that works with a threaded wall fitting for mounting to a spa's water contacting wall. The fitting is mated with the body threads 82 until the flange 80 tightens against the spa wall and the jet 70 is held securely in place with the spa wall sandwiched between the flange 80 and the fitting.

The diffuser 78 is housed within the jet body 72 by conventional means, such as by a retaining ring 84 (FIG. 8) with the diffuser 78 being rotatable within the body 72 about the jet body's longitudinal axis. The diffuser 78 has a diffuser flange 86 that can be used to turn the diffuser to control the amount of water that passes into the body 72.

Similar to the water inlet 16 in jet 10 above, the water inlet 76 is a separate construction that provides the above-described flexibility in aligning the water inlet when connecting water conduits to the jet body. The jet 70 also provides the added flexibility of having an adjustable air inlet that provides added flexibility in aligning the air inlet 74 when connecting an air conduit. The jet 70 comprises an air inlet sleeve 94 mounted between the water inlet 76 and the remainder of the jet body 72. As best shown in FIG. 8, the jet body 72 has an axial ridge 96 that holds a mounting nut 98 on the jet body 72. The mounting nut has inside nut threads 100 arranged to mate with outside threads 102 on the forward end of the air inlet sleeve 94. A space is provided between the inside surface of the inlet sleeve 94 and the jet body 72. The forward end of the sleeve 94 fits closely within this space, with the nut threads 100 mating with the sleeve threads 102. The sleeve 94 is turned toward the forward end of the jet body 72 until the sleeve ridge 104 meets the opposing body ridge 106. First and second O-rings 108, 110 are arranged between the jet body 72 and the inside surface of the inlet sleeve 94 to provide a watertight seal.

By having this sleeve 94 and body 72 arrangement the air inlet can be rotated around the body's longitudinal axis to align it with the air conduit. Once aligned, the sleeve 94 can be fixed in place by tightening the mounting nut 98. The water inlet 76 has a cylindrical inlet section 88 that is perpendicular to a cylindrical mounting section 90. The mounting section 90 includes a smooth water inlet mounting surface 92 that is sized to fit closely over a mounting surface 112 at the rear end of the sleeve 94. This arrangement allows for the water inlet to be rotated around the longitudinal axis of the body 72 to align the cylindrical inlet section 88 with the water conduit.

The rear of the jet body 72 is housed substantially within the rear portion of the sleeve 94 and the overlapping mounting section 90 of the water inlet 76. The diffuser 78 is similar to the diffuser 18 described above and shown in FIGS. 2 and 3. The diffuser 78 has a rear opening 116 that allows water to enter the diffuser 78. Water enters the jet 70 through the water inlet 76, and the rear of the body 72 has an offset longitudinal opening 118 that allows water into the jet body 72. The diffuser rear opening 118 is arranged to work with the body's longitudinal opening 118 to control the flow of water into the diffuser 78. As described above, when the diffuser rear opening 116 is aligned with longitudinal opening 118 the maximum amount of water flows into the diffuser 78 through the aligned holes. As the diffuser 78 is rotated within the jet body, the diffuser rear opening 116 is moved out of alignment with the longitudinal opening 118 to reduce or stop the flow of water.

As in jet 10, the remaining operation of the diffuser 78 is known. Air enters the jet body 72 through the air inlet 74 where it can be entrained into the water due to the venturi action, producing a jet with a desirable water/air mixture. Different components can be included within the jet 70 and the diffuser 78 to produce different jet effects, such as a rotating or pulsating jet.

Figure 10:
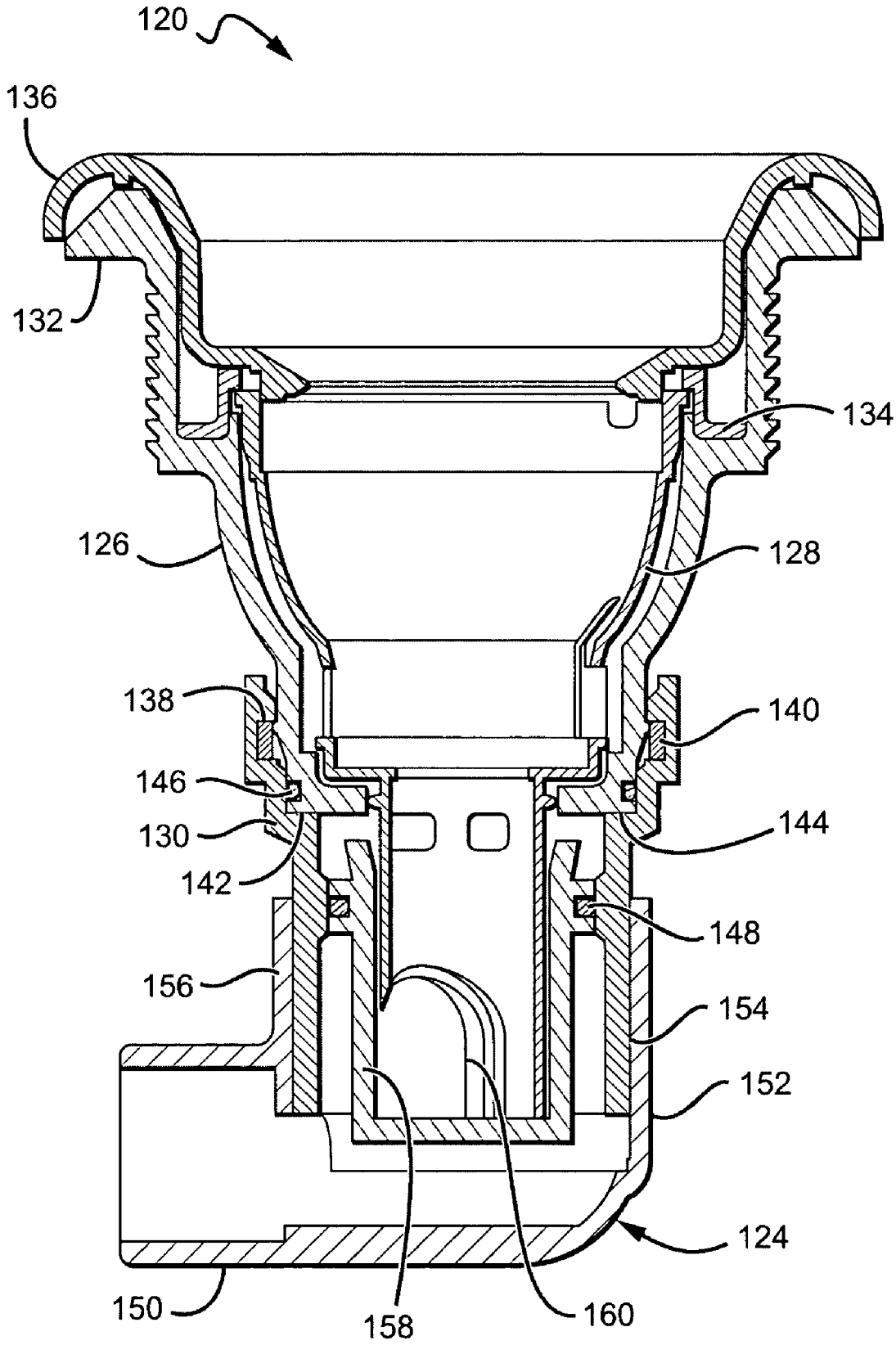
FIG. 10 is an sectional view of another embodiment of a hydrotherapy jet according to the present invention.
Figure 11:
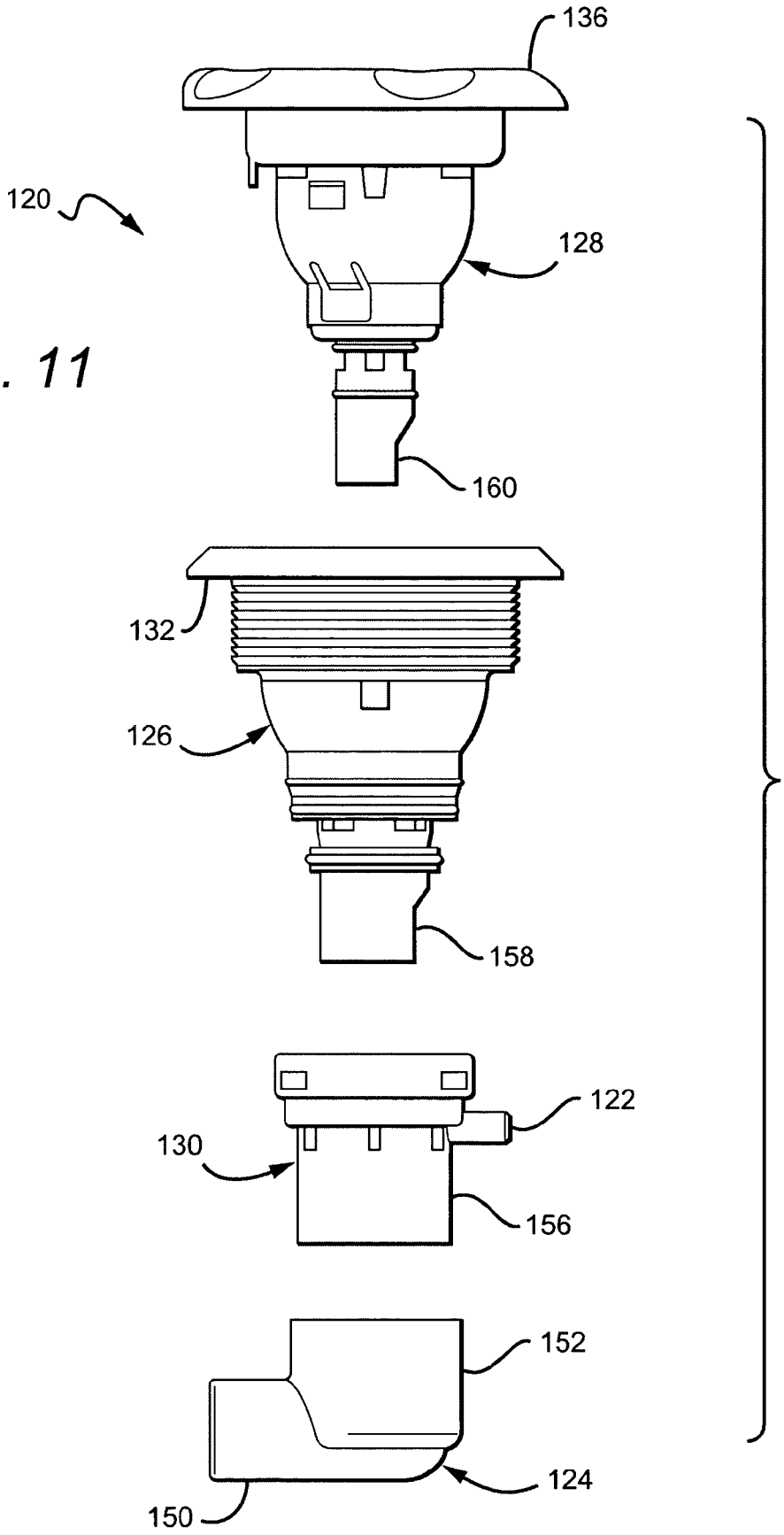
FIG. 11 is an exploded view of the jet in FIG. 10.

FIGS. 10 and 11 show another embodiment of a hydrotherapy jet 120 according to the present invention that is similar to the jet 70 in FIGS. 7-9 and also comprises adjustable air and water inlets 122, 124. The jet 120 comprises a jet body 126, a diffuser 128, and air inlet sleeve 130. The components of jet 120 are also formed from a water impervious plastic such as ABS, PVC or CPVC and the jet 120 is also typically positioned below the water level on the spa or tub wall, with the majority of the jet positioned behind the spa's water contacting wall. A water conduit is connected to the water inlet 124 and an air conduit can be connected to the air inlet 122 to supply air to the body 126. The jet body 126 also has an external body flange 132 that works with a threaded wall fitting for mounting to a spa's water contacting wall as described above in describing jet 70.

The diffuser 128 is housed within the jet body 126 by a retaining ring 124 (FIG. 10) with the diffuser 128 being rotatable about the jet body's longitudinal axis. The diffuser 128 has a diffuser flange 136 that can be used to turn the diffuser 128 to control the amount of water that passes into the body 126.

Similar to the water inlet 76 and air inlet sleeve 94 in jet 70 above, the water inlet 124 and air inlet sleeve 130 are a separate construction and provide the air and water inlets 122, 124 adjustability when connecting air and water conduits to the jet body 126. The jet 120, however, uses a different construction in mounting the air inlet sleeve 130 to the jet body 126. Instead of using a mounting nut to mount the sleeve, the forward end of the air inlet sleeve 130 has an axial lip 138 on its inside surface that cooperates with an axial ridge 140 on the jet body to hold the sleeve 130 on the jet body 126. The axial lip 138 snaps over the axial ridge, with a sleeve forward facing ledge 142 butting against a body rear facing ledge. First and second O-rings 146, 148 are provided between the body 126 and the sleeve 130 to provide a watertight seal. This arrangement allows for the sleeve 130 to rotate around the body 126 while maintaining a watertight seal between the two.

The water inlet 124 has a cylindrical inlet section 150 that is perpendicular to a cylindrical mounting section 152, although other types of water inlets can-be used. The mounting section 152 includes a smooth water inlet mounting surface 154 that is sized to fit closely over a sleeve mounting surface 156 at the rear end of the sleeve 130. This arrangement allows for the water inlet 124 to be rotated around the longitudinal axis of the body 126 to align the cylindrical inlet section 150 with the water conduit.

Similar to the operation of jets 10 and 70 described above, the diffuser 128 in jet 120 cooperates with the jet body 126 to control the amount of water flowing through the diffuser 128. Water enters the jet 120 through the water inlet 124, and the rear of the jet body 126 has an offset longitudinal opening 158 that allows water into the jet body 126. The diffuser 128 has a rear opening 160 that allows water to enter the diffuser 128 and the diffuser rear opening 160 is arranged to work with the body's longitudinal opening 158 to control the flow of water into the diffuser 128. When the diffuser rear opening 160 is aligned with longitudinal opening 158 the maximum amount of water flows through diffuser 128, and as the diffuser 128 is rotated within the jet body, the diffuser rear opening 160 is moved out of alignment with the longitudinal opening 158 to reduce or stop the flow of water through the diffuser 128.

For both jets 70 and 120, by having the water enter through the bottom of the body, the orientation of the inlets 76, 124 does not impact the operation of their diffusers 78, 128 in controlling the flow of water through the jets 70, 120. Similarly, the orientation of their air inlet sleeves 94, 130 does not impact the operation of the diffusers 78, 128. The operation is the same regardless of the inlet's orientation, which provides the flexibility necessary to match the air and water inlet orientation to the orientation of the air and water conduits.

The installation method for the jets 70 and 120 is the same as the method for installing the jet 10 in a hydrotherapy spa system, with the additional steps of aligning the air inlets 74, 122 to align them with their air conduits. The air conduits can then be mounted to the air inlets 74, 122.

Figure 12:
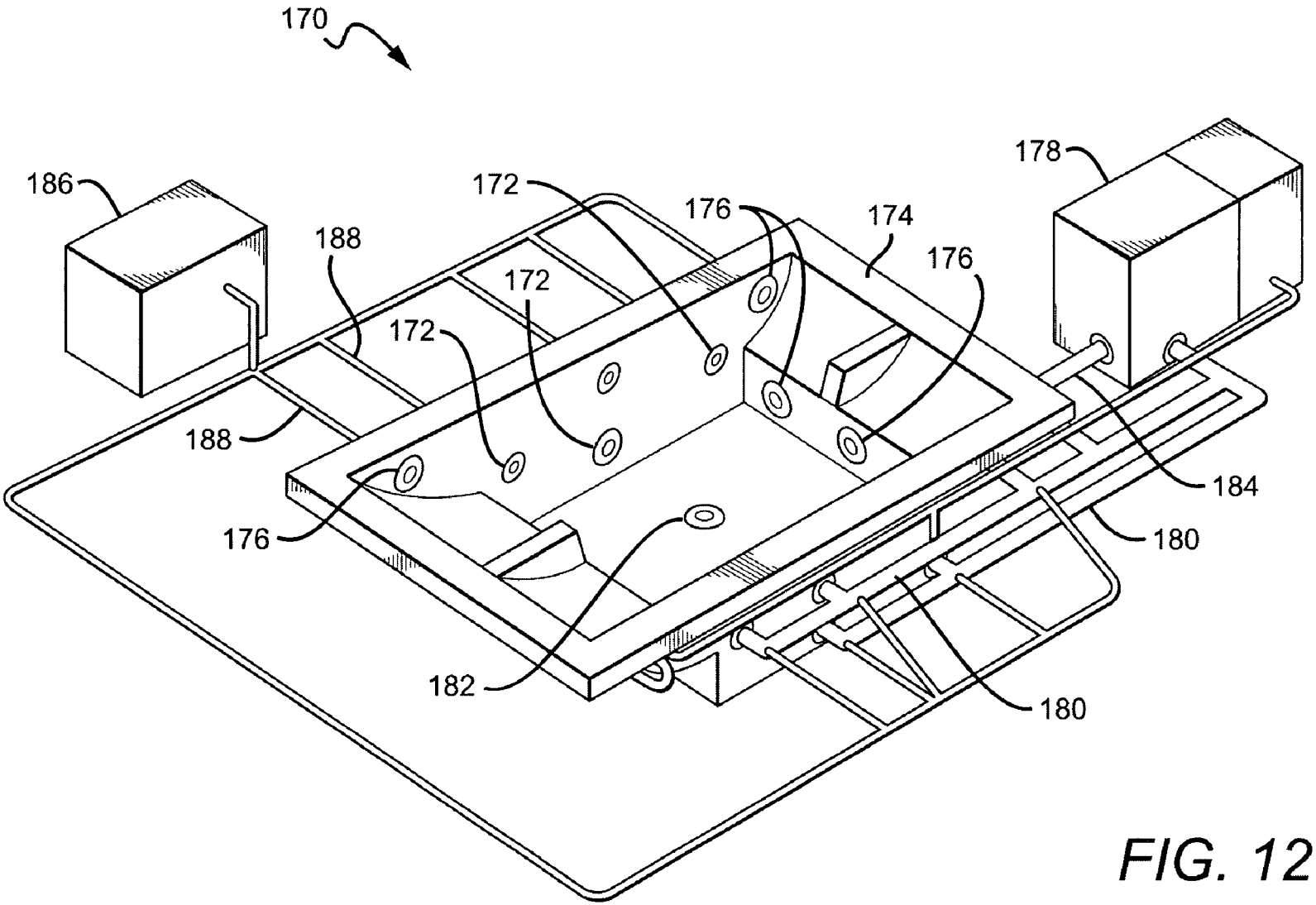
FIG. 12 is a perspective view of one embodiment of a hydrotherapy system according to the present invention.

FIG. 12 shows a hydrotherapy system 170 wherein multiple jets 172 can be installed in a reservoir shell 174 such as a tub or spa. Some or all of the jets can be one of the jets 10, 70, or 120 described above, with the remaining jets 176 being any other desired type, such as a variety of prior single nozzle jets. Both types of jets are connected to a water pump 178, used to circulate the water throughout the spa system, by a series of water conduits 180. Water from shell 174 is provided to pump 178 through the drain 182, which is connected through return water conduit 184 to pump 178. Water from pump 178 is provided back to shell 174 by conduits 180, where it flows into jets 172 and 176, as the case may be, and in turn into shell 174, completing the loop. Additionally, an air system 186 can be included that provides air to individual jets 172 and 176 through air conduits 188, to aerate the water flowing through the jets. The air system 186 can be pump driven to increase the pressure of the air entering the jets 172 and 176, or can be vacuum based with the venturis located within the jets 172 and 176 drawing air into the water flow stream.

Although the present invention has been described in considerable detail with reference to certain preferred configurations, other versions are possible. The invention can be used in many different types of hydrotherapy jets and different jet inlets. It can also be used with many different types of diffusers. Other jets can also have a water outlet alone, without air. Therefore, the spirit and scope of the invention should not be limited to the preferred versions described above.

I claim:

1. A hydrotherapy jet, comprising:

a jet body having an air inlet to allow air to flow into said jet body, wherein said jet body further comprises an exterior smooth cylindrical body mounting surface and an interior axial cavity established in an interior of said jet body, each of said exterior cylindrical body mounting surface and said axial cavity offset from said jet body's longitudinal axis, said axial cavity having an offset slot opening on an inside surface of said axial cavity to allow water to enter an interior of said jet body;

a water inlet having separate construction from said jet body, said water inlet having a cylindrical mounting section coupled to said exterior cylindrical body mounting surface to allow water from said water inlet to enter said jet body regardless of the relative orientation of said water inlet's position around said jet body's longitudinal axis; and a diffuser housed within said jet body, wherein said diffuser comprises a longitudinal rear opening that cooperates with said offset slot opening, such that when said rear opening is at least partially aligned with said offset slot opening, water from said water inlet is allowed to flow into said interior of said jet body.

2. The hydrotherapy jet of claim 1, further comprising an air inlet sleeve, said air inlet integral to said inlet sleeve, said sleeve mounted to said jet body and rotatable about the longitudinal axis of said jet body to align said air inlet with said air conduit.

3. The hydrotherapy jet of claim 2, wherein said jet body further comprises an inlet mounting surface arranged to allow said water inlet to be rotated about said jet body to align said water inlet with said water conduit.

4. The hydrotherapy jet of claim 1, wherein said jet body comprises a rear section with a longitudinal opening, wherein said diffuser rear opening cooperates with said longitudinal opening to control the amount of water flowing into said diffuser.

5. The hydrotherapy jet of claim 4, wherein water can flow into said diffuser when said longitudinal opening is at least partially aligned with said rear opening.

6. The hydrotherapy jet of claim 4, wherein the maximum amount of water flows into said diffuser when said longitudinal opening is aligned with said rear opening, and water is blocked from flowing into said diffuser when said longitudinal and rear openings are out of alignment.

7. The hydrotherapy jet of claim 1, wherein said diffuser mechanism comprises a flange which enables said diffuser to be manually rotated by a spa user.

8. The hydrotherapy jet of claim 1, wherein said diffuser further comprises a mechanism which enables it to be externally and manually rotated, said diffuser rotatable within said jet body to control the amount of water flowing into said jet body.

9. A hydrotherapy jet, comprising:

a jet body having a slot structure to allow water to flow into said jet body from a water conduit connected to said jet body;

an air inlet integral to said jet body to receive an air conduit, said air inlet arranged to allow air to flow into said body;

a water inlet having separate construction from said jet body and said air inlet, said water inlet coupled between said water conduit and said jet body, said slot structure configured to allow water from said water inlet to enter said jet body regardless of the relative orientation of said water inlet's position around said jet body's longitudinal axis; and a diffuser housed within said jet body, wherein said diffuser comprises a longitudinal rear opening that cooperates with said slot structure, such that when said rear opening is at least partially aligned with said slot structure, water from said water inlet is allowed to flow through said jet body, wherein said diffuser further comprises a mechanism which enables it to be externally and manually rotated, said diffuser rotatable within said jet body to control the amount of water flowing into said jet body, wherein said water inlet is rotatable about the longitudinal axis of said jet body to align said water inlet with said water conduit, wherein said jet body is arranged to channel water from said water inlet to said slot structure inside said jet body, said diffuser rotatable to cooperate with said slot structure to receive water for any orientation of said water inlet.

10. The hydrotherapy jet of claim 9, wherein said jet body comprises a rear section with a longitudinal opening wherein said diffuser rear opening cooperates with said longitudinal opening to control the amount of water flowing into said diffuser.

11. The hydrotherapy jet of claim 10, wherein water can flow into said diffuser when said longitudinal opening is at least partially aligned with said rear opening.

12. The hydrotherapy jet of claim 10, wherein the maximum amount of water flows into said diffuser when said longitudinal opening is aligned with said rear opening, and water is blocked from flowing into said diffuser when said longitudinal and rear openings are out of alignment.

13. The hydrotherapy jet of claim 9, wherein said diffuser mechanism comprises a flange which enables said diffuser to be manually rotated by a spa user.

14. A hydrotherapy jet, comprising:

a jet body with a slot structure;

an air inlet sleeve having an integral air inlet and an exterior cylindrical mounting surface, said inlet sleeve mounted to said jet body, said air inlet allowing air to flow into said body;

a water inlet having a separate construction from said jet body and said air inlet sleeve, said water inlet mounted to said exterior cylindrical mounting surface said water inlet configured to receive a water conduit to allow water to flow into said slot structure regardless of said water inlet's orientation around said jet body's longitudinal axis; and a diffuser housed within said jet body, wherein said diffuser comprises a longitudinal rear opening that cooperates with said slot structure, such that when said rear opening is at least partially aligned with said slot structure, water from said water inlet is allowed to flow through said jet body, wherein said diffuser further comprises a mechanism which enables it to be externally and manually rotated, wherein said jet body is arranged to channel water from said water inlet to said slot structure inside said jet body, said diffuser cooperating with said slot structure and said air inlet to receive water and air, respectively, for any orientation of said water inlet.

15. The jet of claim 14, wherein said diffuser is rotatable within said jet body to control the amount of water flowing into said jet body.

16. The jet of claim 14, wherein said air and water inlets are rotatable to align them with air and water conduits, respectively.

17. A hydrotherapy jet, comprising:

a jet body with a slot structure;

an air inlet rotatable about said jet body, said air inlet allowing air to flow into said body;

a water inlet having a separate construction from said jet body and said air inlet, said water inlet rotatable about said air inlet, said water inlet configured to allow water to flow into said slot structure regardless of said water inlet's orientation around said jet body's longitudinal axis; and a diffuser housed within said jet body, wherein said diffuser comprises a longitudinal rear opening that cooperates with said slot structure, such that when said rear opening is at least partially aligned with said slot structure, water from said water inlet is allowed to flow through said jet body, wherein said diffuser further comprises a mechanism which enables it to be externally and manually rotated, wherein said jet body is arranged to channel water from said water inlet to said slot structure inside said jet body, said diffuser cooperating with said slot structure and said air inlet to receive water and air, respectively, for any orientation of said water inlet.

18. The jet of claim 17, wherein said diffuser is rotatable within said jet body to control the amount of water flowing into said jet body.

19. The jet of claim 17, wherein said air and water inlets are rotatable to align them with air and water conduits, respectively.

* * * * *